US005404827A

United States Patent [19]

Baltz et al.

[11] Patent Number: 5,404,827

[45] Date of Patent: Apr. 11, 1995

[54] GRAVITY OUTLET

[75] Inventors: Dwain J. Baltz, St. Peters; Roger A. Dalske, Florissant; Dennis J. Schipper, St. Charles, all of Mo.

[73] Assignee: ACF Industries, Incorporated

[21] Appl. No.: 52,135

[22] Filed: Apr. 23, 1993

[51] Int. Cl.[6] ..... B61D 7/00

[52] U.S. Cl. ..... 105/282.3

[58] Field of Search ..... 105/280, 282.1, 282.2, 105/282.3, 305, 286, 293, 294, 295

[56] References Cited

U.S. PATENT DOCUMENTS

| | | | |
|---|---|---|---|
| 3,138,117 | 6/1964 | Dorey | 105/282.3 |
| 3,415,204 | 12/1968 | Pase | 105/305 |
| 3,779,172 | 12/1973 | Schipper et al. | 105/305 |
| 3,877,392 | 4/1975 | Akester et al. | 105/253 |
| 3,938,861 | 2/1976 | Bagwell | 105/282.3 |
| 4,036,532 | 7/1977 | Waddell et al. | 302/53 |
| 4,214,536 | 7/1980 | Waddell et al. | 105/305 |
| 4,301,741 | 11/1981 | Chierici | 105/305 |
| 4,528,913 | 7/1985 | Randolph | 105/282 A |
| 4,534,298 | 8/1985 | Scott | 105/282.3 |
| 4,599,948 | 7/1986 | Randolph | 105/282.3 |

FOREIGN PATENT DOCUMENTS

| | | | |
|---|---|---|---|
| 0587985 | 12/1959 | Canada | 105/282.2 |

*Primary Examiner*—Mark T. Le

*Attorney, Agent, or Firm*—Polster, Lieder, Woodruff & Lucchesi

[57] ABSTRACT

A sliding gate type gravity outlet (10) is for use on railcars (C) for discharging a lading. A pan assembly (12) defines an outlet pan (14) having a flange (18) attached to the discharge opening and sidewalls (20) sloping downwardly from the flange. A bottom portion of the sidewalls defines a discharge outlet (22) into which lading flows. An outlet gate (24) is movable relative to the opening to open and close the outlet. Lading to be discharged bears upon the gate when it is in its closed position. A rack and pinion gear arrangement (36) is used to move the gate back and forth between these positions, and a rod (62) guides movement of the gate. The gate sealingly abuts against a seal (32) when the gate is closed to prevent loss of lading. The guide mechanism sits at an angle (X1) with respect to the outlet, and the gate is set at a second and greater angle (X2) with respect thereto. As the gate moves from its closed to its open position, it is drawn away from the seal and does not slide over it. By being drawn away, rather than sliding over the seal, wear of the seal is reduced.

25 Claims, 4 Drawing Sheets

GRAVITY OUTLET

BACKGROUND OF THE INVENTION

This invention relates to gravity outlets used on railway cars to discharge lading and, more particularly, to an improved gravity outlet for use on such cars.

Gravity outlets for use on railroad cars are known in the art. See, for example, U.S. Pat. Nos 4,528,913, 4,036,532, and 3,877,392, which are assigned to the same assignee as the present invention, and which relate to a gravity outlet construction or gate/seal arrangement. The outlets shown in these patents are sliding gate outlets. That is, they have a horizontal plate, or gate, which is moved horizontally back and forth to open and close the outlet. A guide is typically provided to insure proper movement of the gate, prevent binding, etc. Because there is lading resting on top of the closed gate, the force required to open the gate has to overcome this weight. This makes opening of the gate more difficult.

As it moves, the gate bears down on a seal provided to prevent spillage of lading and lading contamination. Contamination occurs when dirt and other contaminants find their way into the compartment where the lading is stored. Over time, the close contact between the gate, its guide, and the seal causes wear. Wear particularly occurs when the gate slides open and there are particles caught between the gate and the seal. This wear, as well as the sealing ability of the seal are also effected by the constant vibration to which the outlet is subjected during movement of the railcar on which the outlet is installed. While removal of the outlet and repair or replacement of parts is not difficult, it is time consuming. Accordingly, the less frequently repairs are needed, the lower the operating costs of the user. It would therefore be advantageous to have a sliding gate outlet in which wear is minimized, but in which the effective functioning of the parts is not impaired.

SUMMARY OF THE INVENTION

Among the several objects of the present invention may be noted the provision of a gravity outlet for use on covered hopper railway cars; the provision of such a gravity outlet to employ a discharge gate through which lading discharges when the gate is open; the provision of such a gravity outlet in which the gate is mounted on a sloping guide mechanism; the provision of such a gravity outlet in which the gate is at an angle greater than that of a guide for the gate so when the gate is opened it "pulls away" from a sealing surface with which it is in contact when the gate is closed, rather than sliding along the sealing surface and lading; the provision of such an outlet in which the gate is installed on the slope so it is biased in its closing direction to make the outlet both easier to close and to seal, and in which opening movement of the gate is away from the force of the lading thereby to make the outlet easier to open; the provision of such a gravity outlet in which the gate assembly and associated parts are readily removable for cleaning the outlet, or repairing or replacing parts of the gate assembly; the provision of such a gravity outlet which does not bind, and in which the amount of torque required to "break-away" the gate is less than is required with conventional gate assemblies; the provision of such a gravity outlet which is operable from either side of the railcar; and, the provision of such a gravity outlet which is usable in place of existing outlets.

In accordance with the invention, generally stated, a sliding gate type gravity outlet is for use on railcars such as covered hopper railcars for discharging a lading from the railcar. A pan assembly defines an outlet pan attachable to a lading discharge opening of the railcar. The pan includes a flange attached to the discharge opening and sidewalls sloping downwardly from the flange. A bottom portion of the sidewalls defines a discharge outlet into which the lading flows. An outlet gate is movable relative to the opening to open and close the outlet. Lading bears down upon the gate when it is in its closed position. A rack and pinion gear is used to move the gate back and forth between these positions, and a guide is used to guide movement of the gate. The gate sealingly abuts against a seal when the gate is closed to prevent loss of lading. The guide mechanism sits at an angle with respect to the outlet, and the gate is set at a second and greater angle with respect thereto. As the gate moves from its closed to its open position, it is drawn away from the guide mechanism and so as not to slide over it as it moves. This movement prevents wear which would otherwise occur as when the gate slides over the seal and there are particles trapped between the gate and seal. Other objects and features will be in part apparent and in part pointed out hereinafter.

BRIEF DESCRIPTION OF THE DRAWINGS

Corresponding reference characters indicate corresponding parts throughout the drawings.

DESCRIPTION OF A PREFERRED EMBODIMENT

Figure 5A:
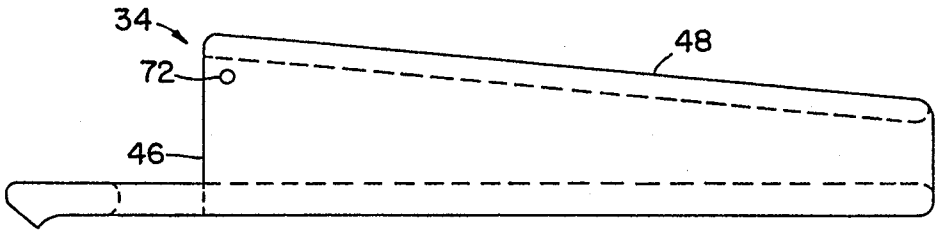
FIG. 5A is a side view of a guide housing used in the outlet.

Referring to the drawings, a railway car C is used to transport a lading L such as a granular, or pelletized lading. The railcar may be a covered hopper railcar of the type well-known in the art. An outlet 10 of the present invention is installed at the lower, outlet opening 0 of a hopper H of the railcar. Outlet 10, as is described in detail hereinafter, is a gravity type outlet. When open, the outlet allows the lading to discharge, by gravity, through outlet 0 of the hopper. It will be understood that while particularly suitable for use on railway cars, the outlet may also be used on over-the-road trucks, storage bins, and other similar containers.

Gravity outlet 10 is used for discharging lading L from the hopper. The outlet first includes a pan means 12. Means 12 comprises an outlet pan 14 attached to lading discharge opening O of the hopper. Opening O is a rectangular opening having a circumferentially extending flange F. Pan 14 is formed of a plurality of sidewall sections **16*a*–16*d* respectively. The sections are generally trapezoidal, when viewed in plan, and respective sections 16*a*, 16*b*, and 16*c*, 16*d* comprise opposed pairs of sections. Sections 16*a*, 16*b* extend transversely of the railcar and form the longer sides of the pan. Sections 16c, 16d extend lengthwise of the car and form the shorter sides of the pan. Each pan section has a flange, 18a–18d respectively, formed at its upper end. These flanges mate with respective portions of flange F to mount outlet 10 in place using bolts B. For this purpose, the flanges have uniformly spaced bolt holes L along their length. Each pan section further has a downwardly sloping sidewall, 20a–20d respectively. The lower ends of the respective sections define a discharge outlet 22 through which lading flows when outlet 10** is opened.

Figure 3:
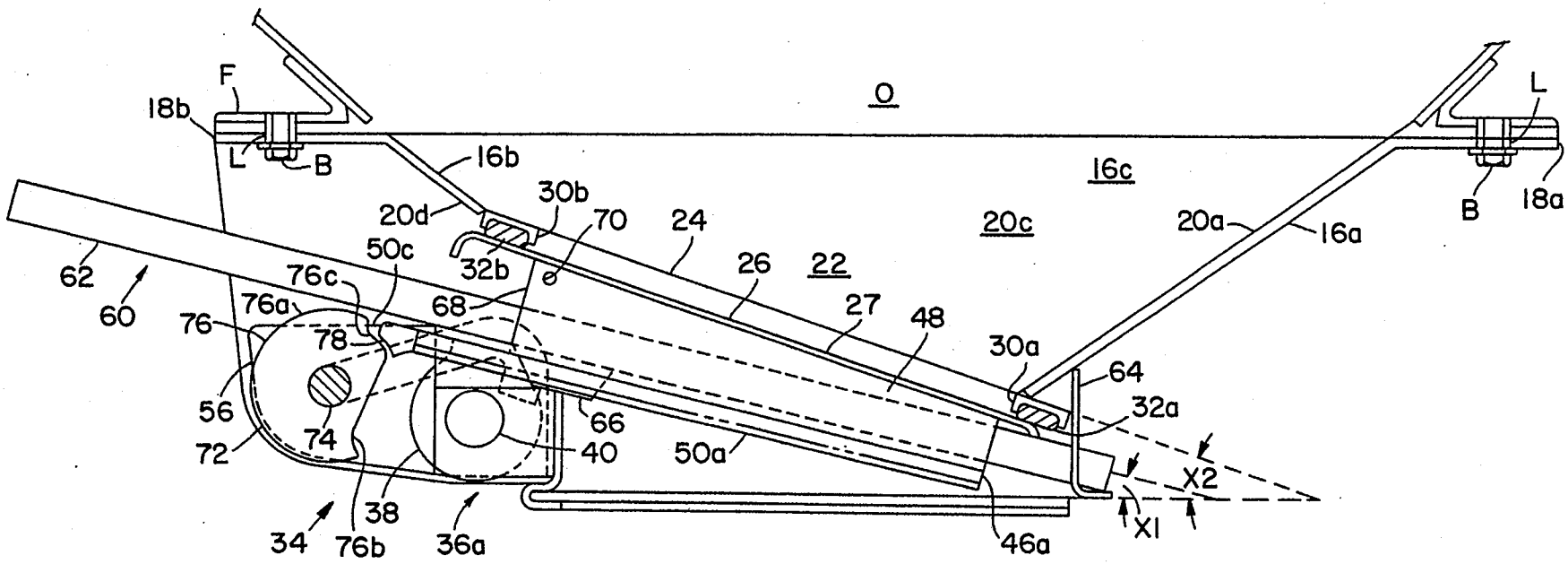
FIG. 3 is a side elevational view of the outlet.

Referring to FIG. 3, it will be seen that the downwardly sloping sidewall of pan section 16a extends downwardly further than the sloping sidewall of opposed section 16b. Accordingly, one side of discharge outlet 22 is substantially lower than the opposite side of the outlet. The sidewalls of the other pair of opposed sections 16c and 16d have sloped bottom edges so that the respective ends of the sidewalls meet with the ends of the sidewalls 20a and 20b. This is as shown for section 16c in FIG. 3.

Next, outlet 10 includes an outlet gate assembly indicated generally 24. Gate assembly 24 includes a gate 26 movable relative to discharge outlet 22 to open and close the outlet. The gate comprises a flat plate 27 whose dimensions are equal to, or are slightly larger than, the size of the discharge opening. As shown in the side view of FIG. 3, inverted U-shaped supports 30a, 30b extend transversely of the plate at the respective lower and upper ends of the plate. Respective pads 32a, 32b are fitted in the channels formed by the supports. The pads extend the length of the respective channels and form seals between the discharge outlet and movable gate 26. Because outlet 10 is installed beneath opening O in the base of hopper H, lading with which the hopper is filled flows through the opening onto the sloped surface of plate 26.

Figure 2:
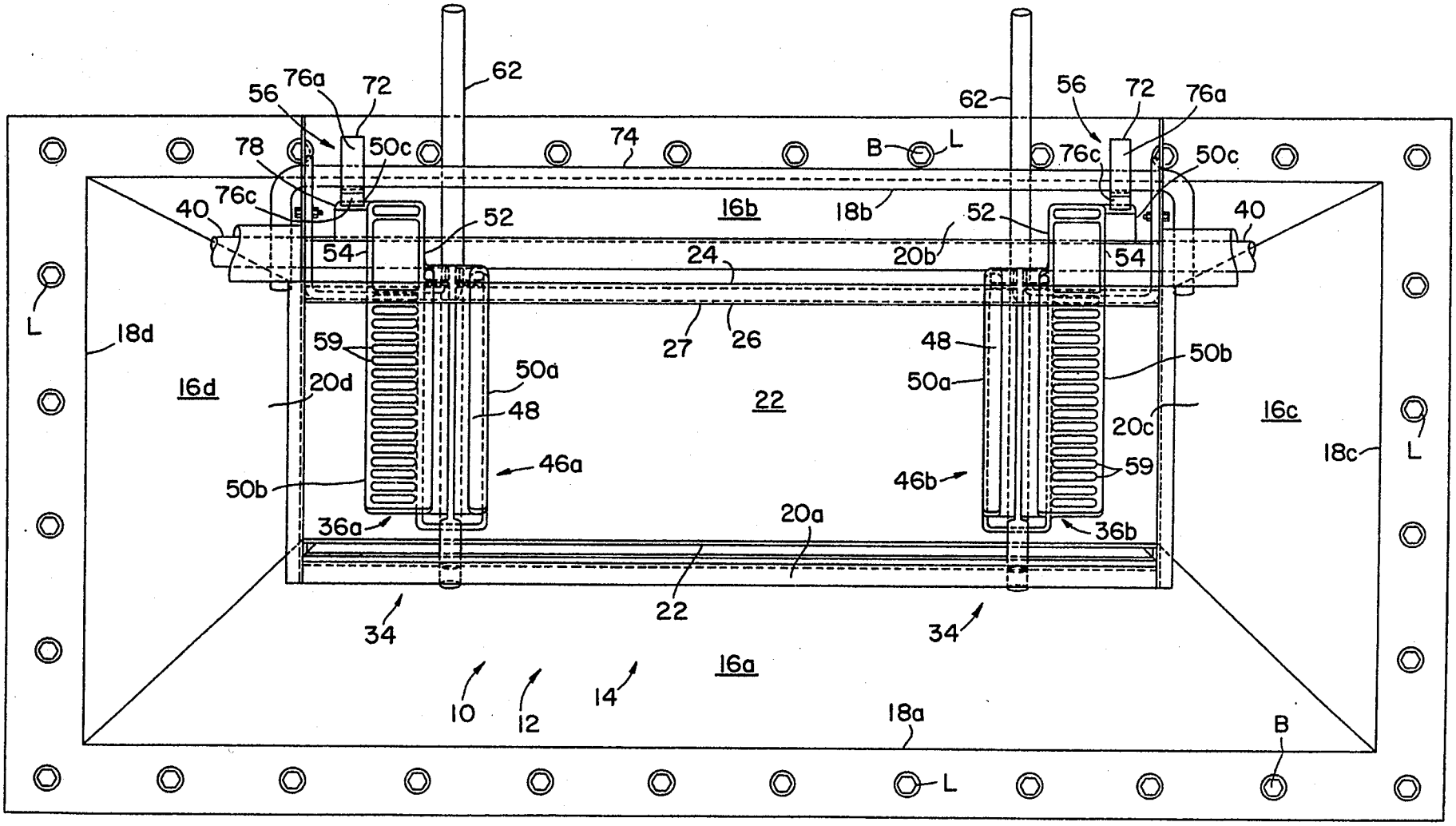
FIG. 2 is a top plan view of the outlet.
Figure 4:
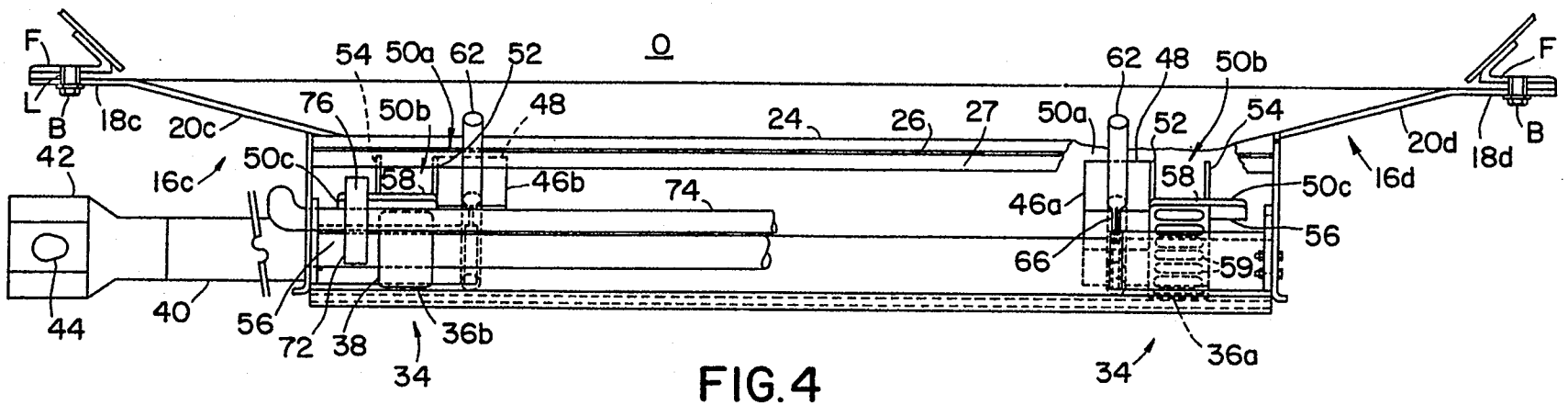
FIG. 4 is an end elevational view of the outlet.

Next, outlet 10 comprises a moving means 34 for moving gate 26 back and forth between its closed and open positions. As best shown in FIGS. 2 and 4, means 34 includes a rack and pinion gear arrangement 36a, 36b respectively located on each side of outlet gate 26. Each arrangement includes a pinion gear 38. These gears are commonly mounted on a drive shaft 40 which extends transversely of railcar C. At the outer ends of the shaft is a capstan 42. By inserting a tool (not shown) in a slot 44 in the capstan, drive shaft 40 can be rotated in either direction. This, in turn, produces rotation of the pinion gears to move its associated rack and open the gate. The capstans 42 allow the gate to be open and closed from either side of the railcar.

Figure 5C:
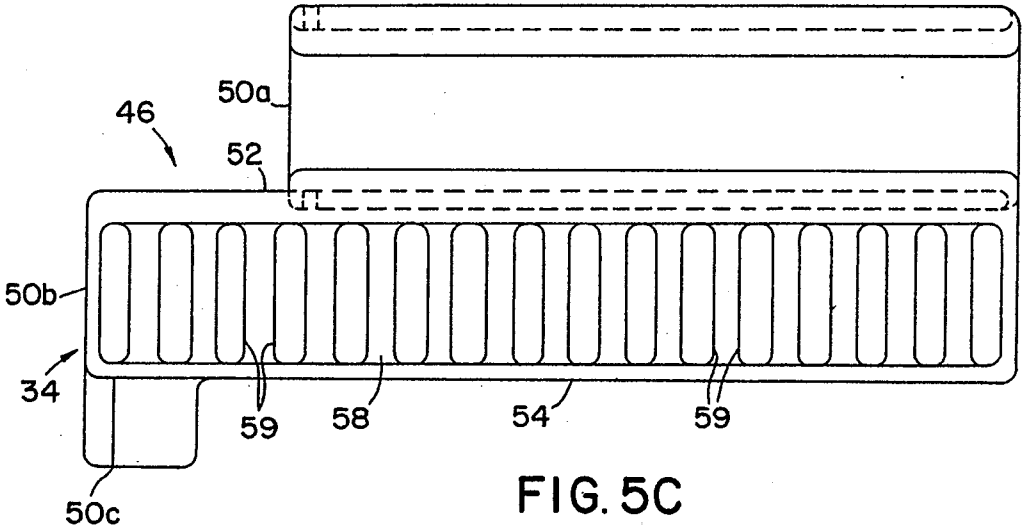
FIG. 5C is a top plan view of the housing.
Figure 5B:
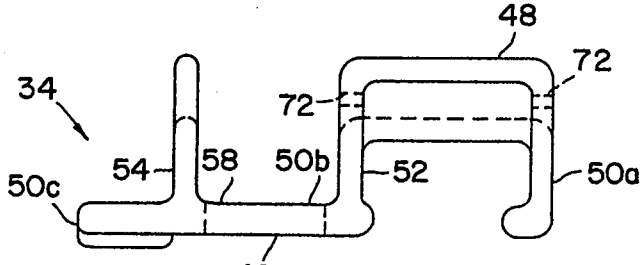
FIG. 5B is an end view of the housing.

Moving means 34 further includes a movable housing 46a, 46b which are respectively installed on opposite sides of outlet 10. As shown in FIG. 3, the respective sides of outlet gate 26 rest upon an upper surface 48 of each housing. Referring to FIG. 5B, each housing is shown to have three sections; an inner section 50a which has an inverted U-shape; a middle section 50b which is U-shaped, and a flat outer section 50c. The top surface of inner section 50a is the upper support surface 48 for the gate 26. A common vertical wall 52 separates the inner housing section from the middle section, and a second common wall 54 divides the middle section from the outer section. As seen in FIG. 5C, section 50c of the housing comprises an outwardly projecting tab located at one end of the housing. This tab is part of a locking means 56 of the outlet which is described in more detail hereinafter.

Referring to FIG. 4, pinion gear 38 of the moving means is installed beneath the outlet pan. The land or base portion 58 of housing section 50b is located directly over this gear. Spaced openings 59 are formed in this base throughout the length of the base. Teeth of pinion gear 38 fit through these openings whereby this portion of the housing comprises the rack portion of moving means 54. Consequently, when shaft 40 is turned in either direction, the rotation of the pinion gears 38 moves housings 46a, 46b in the appropriate direction. This, in turn moves gate 24 in its opening or closing direction.

Outlet 10 further includes a guide means 60 associated with each rack and pinion gear arrangement for guiding movement of outlet gate 26. The guide means includes a rod 62 which is inserted through section 50a of each housing 46. As shown in FIG. 3, rod 62, which is, for example, 1.5"(3.81 cm.) in diameter extends longitudinally through the housing section. The lower end of the rod is supported in an L-shaped bracket 64. The middle portion of the bracket is attached (by welding, for example) to the outer surface of sidewall 20a of pan section 16a. The upper end of the rod is supported by a bracket 66 (see FIG. 3). This bracket is attached to, and depends from, the lower discharge portion of sidewall 20b of pan section 16b. The length of the rod is such that the housings 46a, 46b can move along the rod, in the appropriate direction, when the rack portion of the housing is driven by rotation of the pinion gear 38. Since this length must be equivalent to the width of gate 24, in order for the gate to be moved from its fully closed to its fully open position, the length of the rod corresponds to twice the width of the gate.

Because of the weight of the gate and the weight of the lading bearing down on the upper surface of the gate, outlet 10 includes a bearing means 68 (see FIG. 3) for facilitating movement of the housings. The bearing means includes a nylon-type bearing material such as that sold under the trade name NYLATRON. This material is installed in the closed upper portion of housing sections 50a. The material is held in place by a screw 70 which is inserted into section 50a through the threaded bores 72 at the upper end of the housing section. The bearing material fits about the rod to provide a low friction sliding surface for movement of the housing over the rod.

Figure 1:
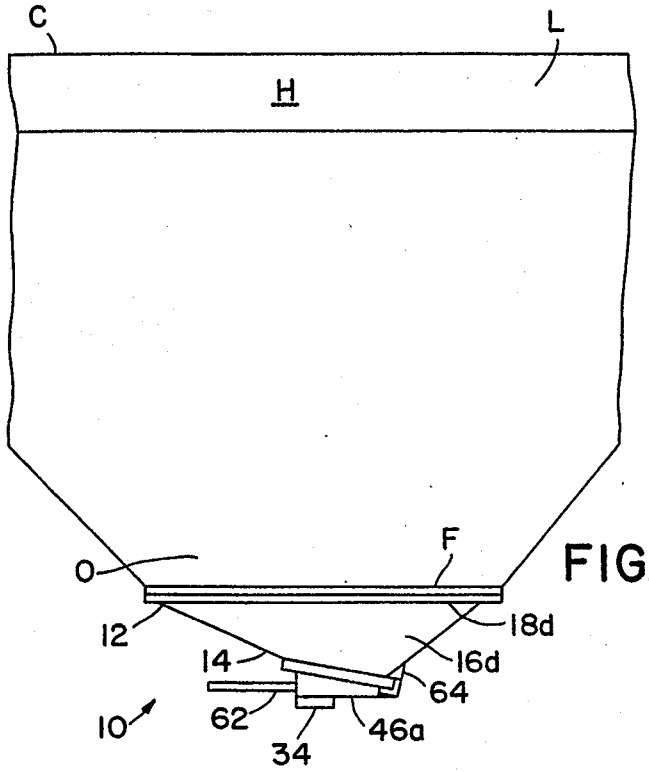
FIG. 1 is a partial view of railcar with a gravity outlet of the present invention installed.

As seen in FIGS. 1 and 3, the rods 62 of guide means 60 are mounted at an angle with respect to the horizontal. This angle is shown as an angle X1 in FIG. 3. As previously described, gate 24 is also set at an angle to the horizontal. This angle is shown as angle X2 in FIG. 3. This second angle at which the gate is set is a greater angle than the angle X1. The angle of gate 24 with respect to the horizontal is reflected in the slope of top surface 48 of housing section 50a. As is evident from FIG. 5A, the base of the housing is flat; while, the height of surface 48 increases from the one end of the housing to the other. The slope created by this construction allows the gate to be supported by the housing with the gate set at the same angle as that determined by the height differential between the lower ends of the sidewalls 20a, 16a of the opposed sections 20b, 16b.

Figure 6A:
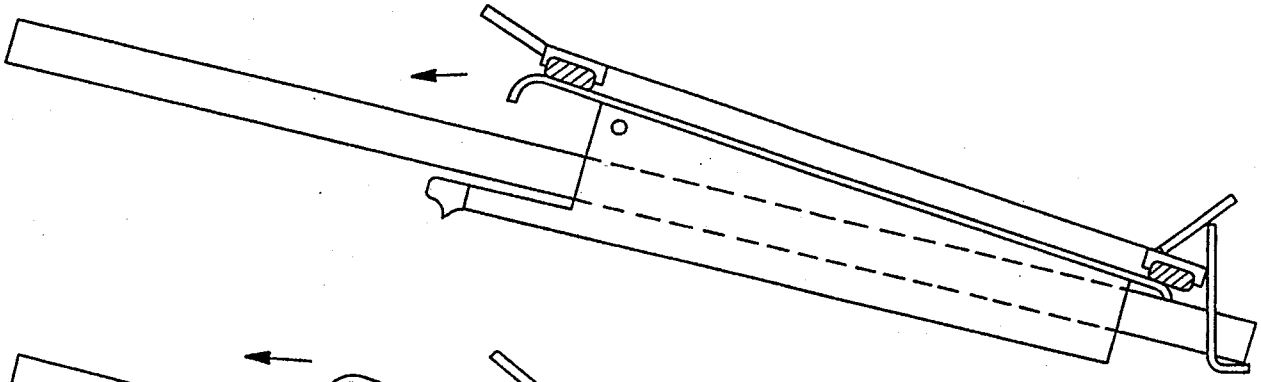
FIGS. 6A–6C illustrate opening movement of the gate and show the gate pulling away from rather than sliding over the seal.
Figure 6B:
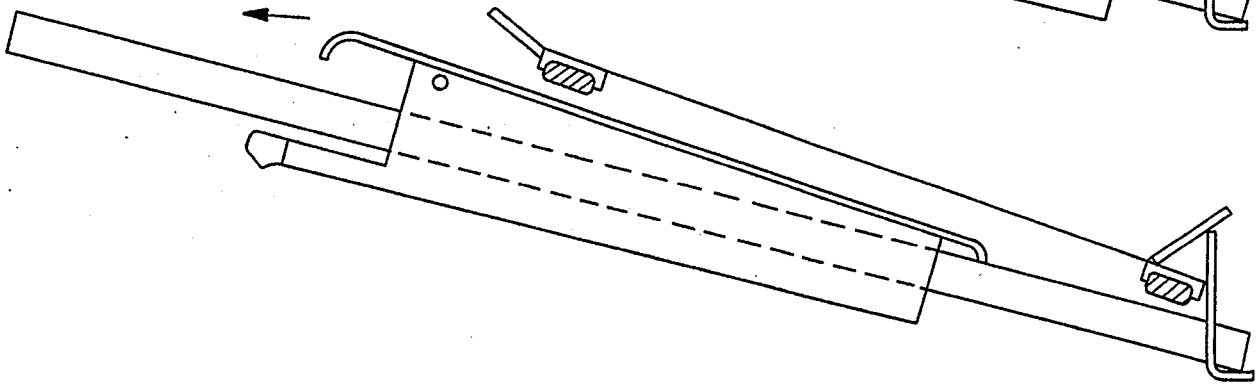
Figure 6C:
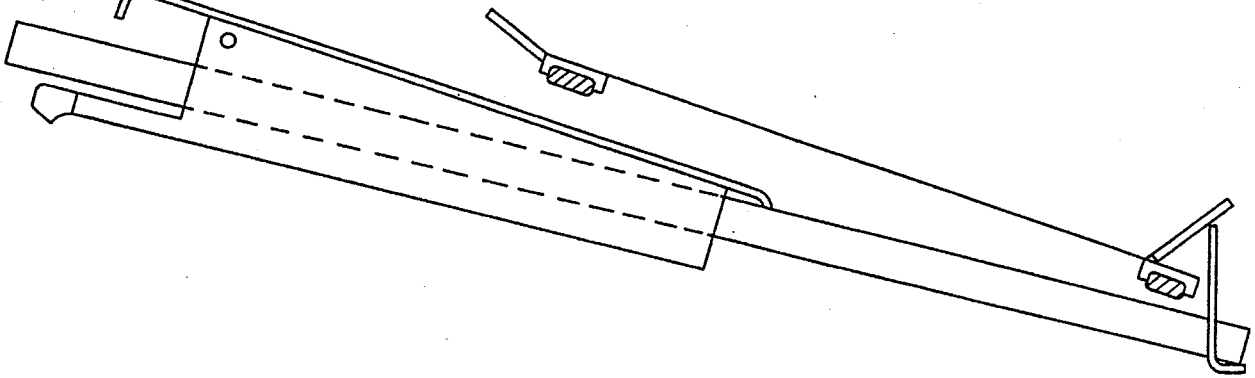

The significance of this differential in angles is that the gate is set at a relatively steeper slope than that of rod 62. When gate 26 is to be moved upwardly to the left, as viewed in FIGS. 6A–6C, the steepness of the slope defined by angle X2 makes it easier to move the gate against the weight imparted to the gate by the lading stored in the hopper. Conversely, once the gate is open, it sits at an angle which biases it downwardly toward its closed position. Thus, if some part of the outlet mechanism fails, the gate will tend to close, keeping the lading in the hopper, rather than allowing lading to continue to pour into the outlet, clogging the outlet or perhaps spilling. Accordingly, the angled setting of the gate and the bias this creates, effects a "fail-safe" mechanism against inadvertent loss of lading. Similarly, when the gate is closed during transport of the lading, the outlet is subjected to constant road vibrations, and various turning, climbing, and impact forces. In conventional outlet assemblies, these forces might be sufficient for the gate to overcome its locking mechanism, so the gate opens and lading spills. With outlet 10 and its gate 26 bias configuration, this is much less likely to happen. Also, the outlet is constantly exposed to dirt particles, debris, and water spray as the railcar is moved. With the configuration of the gate in outlet 10, the possibilities that the lading may be exposed to any of this material is substantially eliminated. It will be particularly noted that the gate does not slide against the seal either as it opens or closes. Accordingly, movement of gate 26 does not grind particles into the seal material. This saves wear on the seal reducing the operating cost of the outlet.

As noted above, section 50*c* of each housing 46 comprises a locking tab portion of a locking means 56. Referring to FIGS. 2 and 3, means 56 is also shown to include a locking gear 72 located at the respective sides of the outlet. As seen in FIG. 2, the locking gears are mounted on a common shaft 74. The respective ends of shaft 74 extend outwardly beyond the sides of the outlet. Further the outer ends of the shaft are turned orthogonally to the intermediate portion of the shaft so to extend rearwardly along the sides of the outlet (to the right as shown in FIG. 3). Also as seen in FIG. 3, this rearwardly extending end of the shaft is formed into a hook. This allows the end of the shaft to either grabbed by hand or a tool so the shaft can be turned.

Each locking gear 72 has an outer cam surface 76 which is formed of three different cam segments that define the cam profile. A first segment 76*a* is a constant radius section which extends around the major portion of the circumference of the shaft. At one end of this segment, the cam surface changes to a flattened aspect indicated 76*b*. This portion of the cam surface is of a smaller radius than segment 76*a*. At the other end of this second segment is formed a short, third segment 76*c* which has radius greater than that of segment 76*b*, but less than that of segment 76*a*. Segment 76*c* converges with segment 76*a* to complete the cam profile. The short segment 76*c* of the cam surface essentially forms a notch in the outer surface of gear 72.

Tab portion 50*c* of housing 46 has a downwardly curving lower face 78 which rests upon the cam surface 76 of gear 72. When shaft 74 is rotated counter-clockwise (as viewed in FIG. 3) the locking gears 72 are correspondingly turned counter-clockwise. This rotation places contact surface 78 of tab 50*c* over cam segment 76*b*. Because this segment has the smallest radius, gate 26 is drawn down below the level of discharge outlet 22. The gate is free to be moved between its open and closed positions, all as previously described. When the gate is closed, and the railcar is readied for transport, shaft 74 is rotated clockwise, turning gear 72 in the same direction. This brings cam segment 76*c* in contact with the tab. Because segment 76*c* is of a greater radius than 76*b*, tab 50*c* is pushed slightly upwardly. This slightly elevates the upper end of gate 24 as shown in FIG. 3. As shown, the upper end of the gate is raised to meet the lower margin of the seal 32 of pan section 16*b*. This abutment further helps prevent the gate from moving during transit of the railcar.

What has been described is a sliding gate gravity outlet for use on covered hopper railway cars. The outlet pan is constructed so that one sidewall is longer than the other. As a result, the outlet gate is canted or angled so to close the outlet. The gate is mounted on a sloping guide mechanism with the gate being set so it is at an angle greater than that of a guide for the gate. Thus, when the gate is opened, it "pulls away" from a sealing surface with which it is in contact when the gate is closed. This is advantageous because the opening movement of the gate is away from the lading which reduces the opening force required; and, it also biases the gate toward its closed position so the vibrations during transit, etc., does not cause the gate to open. The gate assembly and its associated parts are readily removable for cleaning the outlet, or repairing or replacing parts of the gate assembly. In addition, the gate assembly does not bind, and the amount of torque required to "break-away" the gate is less than is required with conventional gate assemblies. The gate assembly is operable from either side of the railcar, can be used in place of existing outlets.

In view of the foregoing, it will be seen that the several objects of the invention are achieved and other advantageous results are obtained.

As various changes could be made in the above constructions without departing from the scope of the invention, it is intended that all matter contained in the above description or shown in the accompanying drawings shall be interpreted as illustrative and not in a limiting sense.

Having thus described the invention, what is claimed and desired to be secured by Letters Patent is:

1. In a gravity outlet for discharging lading from a railway car, the outlet including an outlet pan attached to a lading discharge opening of the railcar, said pan including a plurality of sidewalls each having a flange at their upper end for attachment to the opening and a downwardly sloping sidewall defining a discharge outlet into which lading flows, an outlet gate movable relative to said opening to open and close said outlet, lading flowing through said discharge opening bearing on said gate when it is in its closed position, and a rack and pinion gear arrangement located on opposite sides of said gate for moving said gate back and forth between said open and closed positions, the improvement wherein one sidewall of an opposed pair of sidewalls comprising said pan extends downwardly further than the other sidewall and said gate is installed at an angle with respect to the horizontal to close said discharge outlet, and further including;

means for rotating the pinion gear in either direction to move the gate;

guide means associated with each rack and pinion gear arrangement for guiding movement of said outlet gate, said guide means being at an angle to said horizontal, and said gate being at a second and greater angle with respect to the horizontal so as the outlet gate is moved from its closed to its open position, it is drawn away from said guide means, said outlet gate being set at an angle which allows it to be readily moved toward its open position but which biases the gate toward its closed position; and, a movable housing installed on opposite sides of said outlet and on which opposite ends of said outlet gate rest, each said pinion gear being installed beneath said outlet pan and each respective housing including a land located above its associated pinion gear, each land having spaced openings therein forming a rack movable by said pinion gear for rotation of said pinion gears to move said housing and said outlet gate, said guide means including a rod inserted through each said housing, longitudinally of said housing, for said housing to move along said rod, in an appropriate direction, when said rack is moved by said pinion gear.

2. The improvement of claim 1 further including locking means for locking said gate in its closed position.

3. The improvement of claim 1 further including bearing means installed in each said housing about said rod to facilitate movement of said housing.

4. The improvement of claim 3 further including means supporting one end of each said rod beneath said discharge outlet at a point below the lower end of said longer sidewall, and the other end of each said rod at a point below the lower end of said shorter sidewall whereby each said rod is at an angle with respect to the horizontal.

5. The improvement of claim 4 wherein the angle of said outlet gate with respect to the horizontal is greater than the angle of each said rod with respect thereto so said outlet gate moves away from said rods as said outlet gate is moved in its opening direction.

6. The improvement of claim 5 wherein said rack and pinion gear arrangements move said housings and outlet gate up the slope formed by said rods and away from the lading to open said gate said slope biasing said gate toward its closed position.

7. The improvement of claim 2 wherein each said housing includes a locking tab and said locking means includes respective locking gears each of which has a cam surface contacted by said respective tabs, each said cam surface having a notch therein in which said tabs fit to lock said housing in one position, and each said locking gear being rotatable to move said notch away from said tab to allow said respective housings to move.

8. The improvement of claim 7 wherein each locking gear includes a cam surface having a first cam segment against which said locking tab bears when said gate is closed, and a second cam segment against which said locking tab bears when said gate is to be opened.

9. The improvement of claim 8 wherein said locking means further includes a shaft on which said locking gears are commonly mounted for rotating said locking gears for said locking tab to be in contact with one said cam segment or the other.

10. The improvement of claim 9 wherein said first cam segment is of a greater radius than said second cam segment so when said locking gear is rotated for said locking tab to be in contact with said first cam segment, one end of said housing is raised to, in turn, lift one end of said gate.

11. The improvement of claim 10 wherein the one said end of said gate which is raised is lifted into abutment with the end of one said sidewalls forming said discharge outlet thereby to prevent movement of said gate during movement of said railcar.

12. A gravity outlet for discharging lading from a railway car comprising:

pan means defining an outlet pan attached to a lading discharge opening of the railcar, said pan means including an upper end attached to the discharge opening and sidewalls sloping downwardly from said upper end, the bottom portion of said sidewalls defining a discharge outlet into which lading flows, said discharge outlet being generally rectangular in shape and said pan means including a separate sidewall forming each side of the outlet with one sidewall of an opposed pair of sidewalls being longer than the other sidewall whereby one side of said discharge outlet is lower than the opposite side thereof;

an outlet gate movable relative to said opening to open and close said outlet, lading flowing into said discharge opening bearing on said outlet gate when said outlet gate is in its closed position, said outlet gate comprising a generally flat plate which when positioned against the lower ends of the sidewalls defining said discharge outlet is set at an angle with respect to the horizontal so to be inclined with respect thereto;

means for moving said outlet gate back and forth between said outlet gate's open and closed positions, said moving means including a pinion gear and a rack movable by turning said pinion gear, capstan means located on both sides of said gravity outlet, and a drive shaft extending between said capstan means, said rack and pinion gear arrangement including a pinion gear mounted on said shaft so to be operable from either side of the gravity outlet, a movable housing on which outlet gate rests, said pinion gear being installed beneath said pan means and said housing including a land located above said pinion gear, said land having spaced openings therein forming a rack movable by said pinion gear whereby rotation of said pinion gear produces movement of said housing and said outlet gate; and, guide means for guiding movement of said outlet gate, said guide means being at an angle to the horizontal, and said gate being at a second and greater angle with respect thereto whereby as the gate is moved from its closed to its open position it is drawn away from said guide means, said outlet gate being set at an angle which allows it to be readily moved toward its open position but which biases the gate toward its closed position, said guide means including a rod inserted through said housing, longitudinally of said housing, for said housing to move along said rod, in an appropriate direction, when said rack is moved by said pinion gear.

13. The gravity outlet of claim 12 further including bearing means installed in said housing about said rod to facilitate movement of said housing.

14. The gravity outlet of claim 12 further including means supporting one end of said rod beneath said discharge outlet at a point below the lower end of said longer sidewall, and the other end of said rod at a point below the lower end of said shorter sidewall whereby said rod is at an angle with respect to the horizontal.

15. The gravity outlet of claim 14 wherein the angle of said outlet gate with respect to the horizontal is greater than the angle of said rod with respect thereto so said outlet gate moves away from said rod as said outlet gate is moved in its opening direction.

16. The gravity outlet of claim 15 wherein said rack and pinion gear arrangement moves said housing and outlet gate up the slope formed by said rod and away from the lading to open said gate, thereby to require less force to open said gate and to bias said gate toward its closed position.

17. The gravity outlet of claim 16 further including a second moving means and a second guide means, the first said moving means and guide means being located on one side of said outlet gate, and said second moving means and guide means being located on the other side thereof.

18. The gravity outlet of claim 12 further including locking means for locking said outlet gate in its closed position.

19. The gravity outlet of claim 18 wherein said housing includes a locking tab and said locking means includes a locking gear having a cam surface contacted by said tab, said cam surface having a notch therein in which said tab fits to lock said housing in one position, and said locking gear being rotatable to move said notch away from said tab to allow said housing to move.

20. A gravity outlet for discharging lading from a railway car comprising:

an outlet pan attached to a lading discharge opening of the railcar, said pan including a plurality of sidewalls each having a flange at their upper end for attachment to the opening and a downwardly sloping sidewall defining a discharge outlet into which lading flows, one sidewall of an opposed pair of sidewalls extending downwardly further than the other;

an outlet gate movable relative to said opening to open and close said outlet, lading flowing through said discharge opening bearing on said outlet gate when said outlet gate is in its closed position;

moving means including a rack and pinion gear arrangement located on opposite sides of said outlet gate for moving said outlet gate back and forth between said open and closed positions, a movable housing installed on opposite sides of said outlet and on which opposite ends of said outlet gate rests, each said pinion gear being installed beneath said outlet pan and each respective housing including a land located above its associated pinion gear, each land having spaced openings therein forming a rack movable by said pinion gear for rotation of said pinion gears to move said housing and said outlet gate;

manually operable means for rotating the pinion gear in either direction to move the outlet gate;

guide means associated with each rack and pinion gear arrangement for guiding movement of said outlet gate, said guide means being at an angle to said horizontal, and said gate being at a second and greater angle with respect thereto whereby as the gate is moved from its closed to its open position, it is drawn away from said guide means, said outlet gate being set at an angle which allows it to be readily moved toward its open position but which biases the gate toward its closed position, said guide means including a rod inserted through each said housing, longitudinally of said housing, for said housing to move along said rod, in an appropriate direction, when said rack is moved by said pinion gear; and, locking means for locking said gate in its closed position.

21. The gravity outlet of claim 20 further including bearing means installed in each said housing about said rod to facilitate movement of said housing.

22. The gravity outlet of claim 20 further including means supporting one end of each said rod beneath said discharge outlet at a point below the lower end of said longer sidewall, and the other end of each said rod at a point below the lower end of said shorter sidewall whereby each said rod is at an angle with respect to the horizontal.

23. The gravity outlet of claim 22 wherein the angle of said outlet gate with respect to the horizontal is greater than the angle of each said rod with respect thereto so said outlet gate moves away from said rods as said outlet gate is moved in its opening direction.

24. The gravity outlet of claim 23 wherein said rack and pinion gear arrangements move said housings and outlet gate up the slope formed by said rods and away from the lading to open said gate said slope biasing said gate toward its closed position.

25. The gravity outlet of claim 20 wherein each said housing includes a locking tab and said locking means includes respective locking gears each of which has a cam surface contacted by said respective tabs, each said cam surface having a notch therein in which said tabs fit to lock said housing in one position, and each said locking gear being rotatable to move said notch away from said tab to allow said respective housings to move.

* * * * *

UNITED STATES PATENT AND TRADEMARK OFFICE

CERTIFICATE OF CORRECTION

PATENT NO. : 5,404,827

DATED : April 11, 1995

INVENTOR(S) : Dwain Baltz, Roger Dalske and Dennis J. Schipper

It is certified that error appears in the above-indentified patent and that said Letters Patent is hereby corrected as shown below:

Column 6
Line 68

Delete - "it" -
Replace with - "said outlet gate" -

Column 10
Line 25
Claim 22

Delete - "20" -
Replace with - "21" -

Signed and Sealed this

Twenty-fifth Day of November, 1997

*Attest:*

Bruce Lehman

BRUCE LEHMAN

*Attesting Officer*

*Commissioner of Patents and Trademarks*